United States Patent [19]

Lunde et al.

[11] 4,318,442

[45] Mar. 9, 1982

[54] METHOD AND APPARATUS FOR CONTROLLING AN UNDERWATER WELL BLOWOUT

[75] Inventors: Peter A. Lunde; Preston S. Phillips, both of Houston, Tex.

[73] Assignee: Ocean Resources Engineering, Inc., Houston, Tex.

[21] Appl. No.: 79,546

[22] Filed: Sep. 27, 1979

[51] Int. Cl.[3] ..... E02B 15/04; E02B 1/00; B03D 1/00

[52] U.S. Cl. ..... 166/357; 166/79; 405/60

[58] Field of Search ..... 166/357, 364, 363, 75 R, 166/362, 337, 79; 169/69; 405/60; 138/97, 98; 210/242

[56] References Cited

U.S. PATENT DOCUMENTS

| | | | |
|---|---|---|---|
| Re. 28,978 | 9/1976 | Brooks | 166/362 X |
| 1,859,606 | 5/1932 | Sievern et al. | 166/79 |
| 3,292,695 | 12/1966 | Haeber | 166/359 X |
| 3,643,741 | 2/1972 | Miranda | 405/60 X |
| 3,653,215 | 4/1972 | Crucet | 405/60 |
| 3,681,923 | 8/1972 | Hyde | 405/60 |

FOREIGN PATENT DOCUMENTS

| | | | |
|---|---|---|---|
| 2822267 | 11/1978 | Fed. Rep. of Germany | 166/75 R |
| 7711698 | 4/1979 | Netherlands | 405/60 |

*Primary Examiner*—James A. Leppink
*Attorney, Agent, or Firm*—Vinson & Elkins

[57] ABSTRACT

An apparatus for controlling an underwater well blowout including a vessel with a lower weighted collar vent ports intermediate the top and bottom of the vessel a valve controlled chimney at the top of the vessel, a gas outlet positioned to provide a gas cap in the vessel when the valve is closed with the vessel in position around the blowing well, an oil outlet above the vent ports and below the gas cap and means for pumping substantially only oil from the vessel at a rate to prevent oil from escaping from the vessel to the sea in substantial quantities. The method includes the steps of lowering a vessel with a weighted collar, a frusto-conical upper section, a valve controlled chimney leading from the upper section, vent parts, an oil outlet above the vent ports and a gas outlet providing a gas cap, over an underwater blowing well with the chimney valve open, seating the vessel on the bottom around and over the blowing well, pumping substantially only oil including entrained gas from the oil outlet and conducting free gas away from the vessel.

2 Claims, 5 Drawing Figures

METHOD AND APPARATUS FOR CONTROLLING AN UNDERWATER WELL BLOWOUT

BACKGROUND

Bringing an underwater well blowout under control is difficult since it is usually accompanied by fire at the surface and damage to the wellhead. This uncontrolled flow of oil and gas is not only a waste of energy but also can be a source of water and beach pollution.

Control of the well flow from a blowout and collection of oil spills therefrom have been handled separately. Control of well flow is attempted by drilling separate wells to feed heavy mud into the flowing well to kill the flow.

Truncated cones have been suggested as a housing to be lowered around a blowing well on land to prevent the well fluids from burning at the wellhead (Howe U.S. Pat. No. 1,830,061). Skimmers and booms have been used to collect and contain oil spills on water. Hoods have been used above the water surface to collect the well flow and deliver it to suitable containers (Verdin U.S. Pat. No. 3,554,290 and Jones U.S. Pat. No. 3,664,429). The Brooks U.S. Pat. No. Re. 28,978 suggests the use of a cone opening downward and positioned immediately above and surrounding the weak section of a flow line from the bottom to the surface to collect oil spilled as a result of the section breaking until the flow is shut off.

SUMMARY

The present invention provides an improved method of and apparatus for controlling an underwater well blowout. The apparatus includes a hollow vessel having sufficient weight and an upper opening so that it can be lowered over a blowing wellhead, a valve to close the upper opening, a gas discharge to maintain a gas cap in the vessel, a liquid discharge below the gas cap, vents in the vessel below the liquid discharge to accommodate for volume changes resulting from the varying flow rates of the well and the fluid discharge. The method includes the steps of lowering the vessel over the flowing well with the upper opening open, landing the vessel around the wellhead, closing the upper opening, connecting the gas and liquid flow lines and flowing gas from the vessel to maintain a gas cap therein and flowing liquids therefrom so that substantially all of the oil with a minimum of water are conducted from the vessel.

An object of the present invention is to provide an improved method and apparatus for controlling an underwater well blowout which is simple, easy to install and prevents further oil pollution and waste until the well is brought under control by killing the flow.

Another object is to provide an improved apparatus to control a well blowout which collects the well fluids on the bottom, makes a rough three phase separation and delivers oil to suitable storage or shipping containers at the surface.

A further object is to provide an improved method and apparatus for controlling an underwater well blowout which does not further damage the wellhead or restrict flow therethrough.

BRIEF DESCRIPTION OF THE DRAWINGS

These and other objects and advantages of the present invention are hereinafter explained with reference to the drawings wherein.

DESCRIPTION OF THE PREFERRED EMBODIMENT

Figure 1:
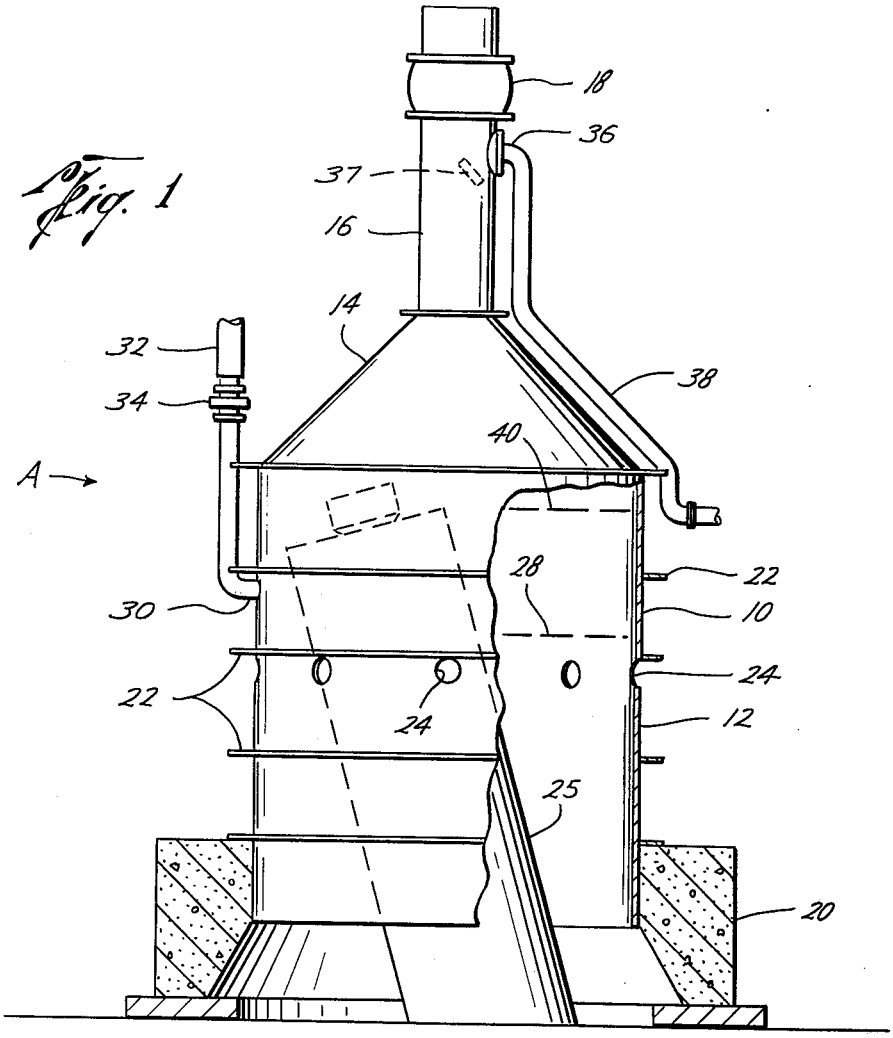
FIG. 1 is a vertical sectional view of the improved containment vessel and separator.

Apparatus A shown in FIG. 1 is designed to be used to control a blowing subsea well when other controls have failed to prevent loss of oil and its polluting effect on the environment. Control apparatus A includes hollow vessel 10 having cylindrical section or body 12, frusto-conical top 14, chimney 16 extending upwardly from the top 14 as shown, valve 18 controlling flow through chimney 16 and base ring 20 providing sufficient weight to assure apparatus 10 remains in its desired position when set around a blowing well as hereinafter described if the structure does not have sufficient inherent weight to be stable.

Vessel 10 has a plurality of optional ring stiffeners 22 secured around its exterior and a plurality of vent ports 24 at a position approximately in the middle of section 12. The level of ports 24 is selected to be below the level of the projecting wellhead 25 so that an oil water interface 28 can be maintained above ports 24 and oil does not pass through ports 24 in any substantial quantities. For some design conditions, vent ports could be eliminated with volume accommodated through the open bottom of apparatus 10.

Oil outlet 30 extends through section 12 above ports 24 and is connected to a suitable line such as submarine hose 32 by quick connectors to optional swivel 34. Gas outlet 36 extends through the upper end of chimney 16 above baffle 37 as shown and connects to line 38 which extends downward as shown. Line 38 may be supported from top 14 or vessel 12 if desired. The position of the lower point in line 38 establishes the oil gas interface 40 and is selected to maintain a gas cap within apparatus 10. As shown, gas oil interface 40 may be set to be in the upper portion of vessel 12 above oil outlet 30. The level of the gas oil interface 40 is selected to be kept below the head of the projecting wellhead 25 and if such is not possible, baffles (not shown) should be included to direct the blowing well products centrally through section 12 to minimize turbulence in the separated oil layer. Baffle 37 is used to deflect liquid from gas outlet 36. The gas to oil ratio for a particular application determines the exact configuration of the ports 24, the oil outlet 30 and the gas outlet 36. For small amounts of gas, the size of gas bubble will be reduced and even eliminated if it is desired to produce the oil with entrained gas without separating free gas in apparatus 10.

Valve 18 is preferably a ball valve or other type of valve to provide a substantially full chimney diameter opening therethrough. It is preferred that both chimney 16 and valve 18 have sufficient size to provide a flow area at least as large as the flow area of the blowing well. Valve 18 also is provided with a remote operator so that it may be operated from the water surface when vessel 10 is landed over a blowing well as hereinafter described.

Although not shown, vessel 10 also is provided with pad eyes and other lifting lugs and suitable winches for pulling oil and gas hoses into their desired position as hereinafter described.

Figure 2:
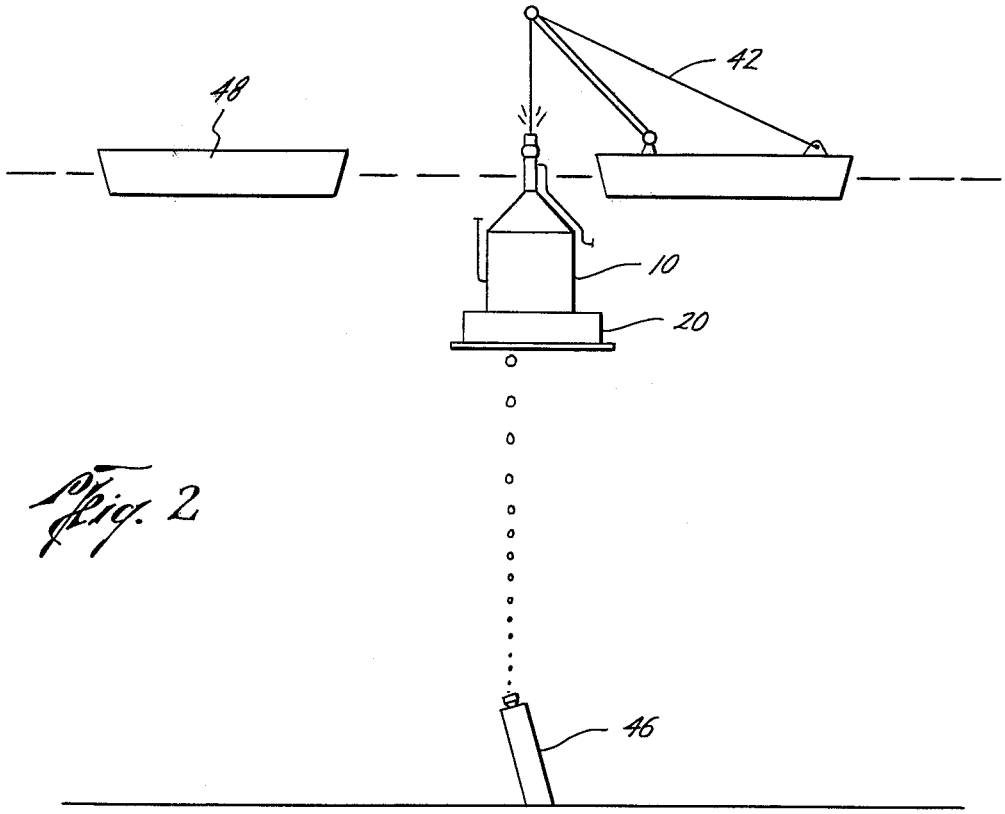
FIG. 2 is a schematic view of an underwater well blowout with the containment vessel being lowered into the water at the surface.
Figure 3:
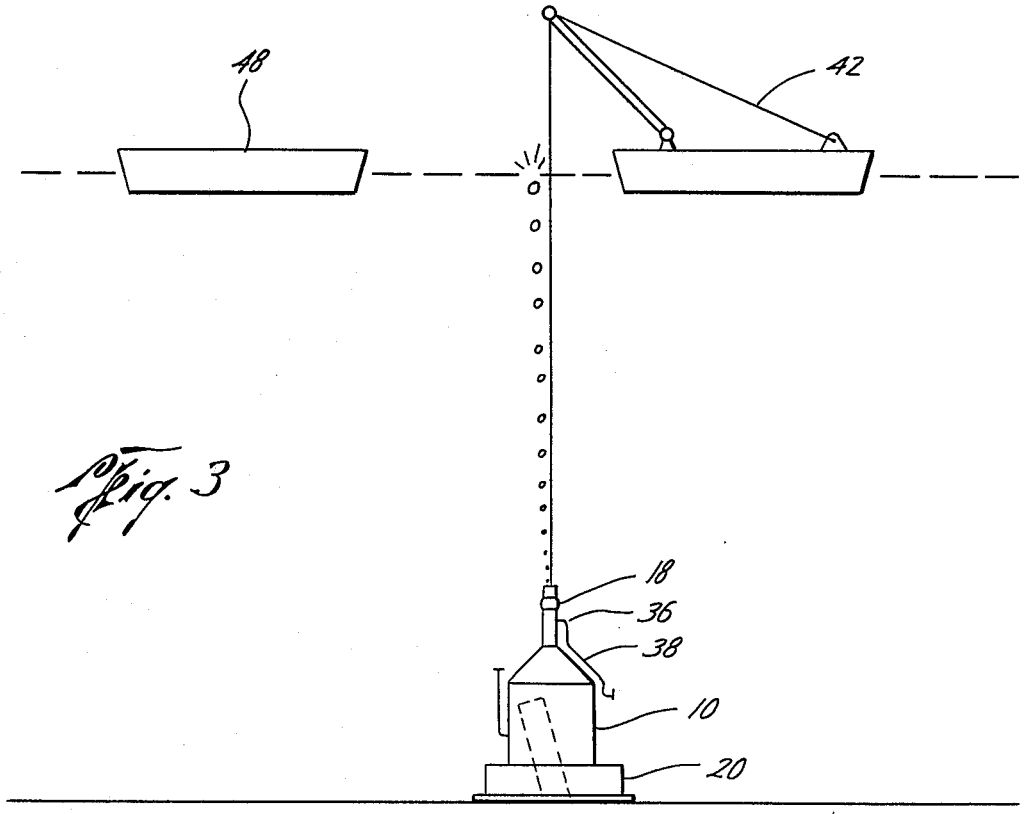
FIG. 3 is a similar view showing the containment vessel approaching the wellhead.

As shown in FIGS. 2 and 3, the vessel 10 is lowered from the surface by a suitable lifting rig 42 on a service barge 44. Vessel 10 is positioned over blowing well 46 at the surface and lowered into position on the bottom in surrounding relation to well 46. If the gas is burning at the surface, it may be desirable to lower vessel 10 with a line (not shown) from production barge 48 so that vessel 10 is lowered initially from a position which is not within the fire zone and then moved to a position vertically above well 46. Valve 18 is open during lowering so that as vessel 10 is lowered over the rising oil and gas flow it can flow therethrough without deflecting vessel 10 or preventing vessel 10 from being properly positioned on the bottom in surrounding relation to the blowing well 46. Alternately, the apparatus may be supported in its installed position by the wellhead structure 25 or by an adjacent structure (not shown). Buoyant hoses shown could then be replaced by lines attached to the structure.

Figure 4:
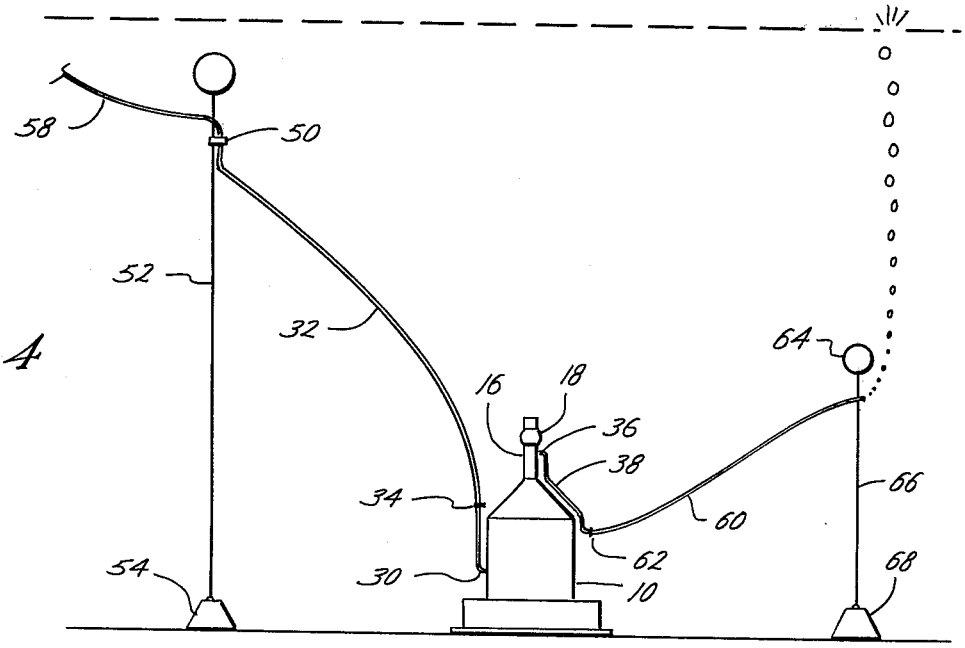
FIG. 4 is another schematic showing the vessel in place around the wellhead with gas and liquid lines connected to the vessel.
Figure 5:
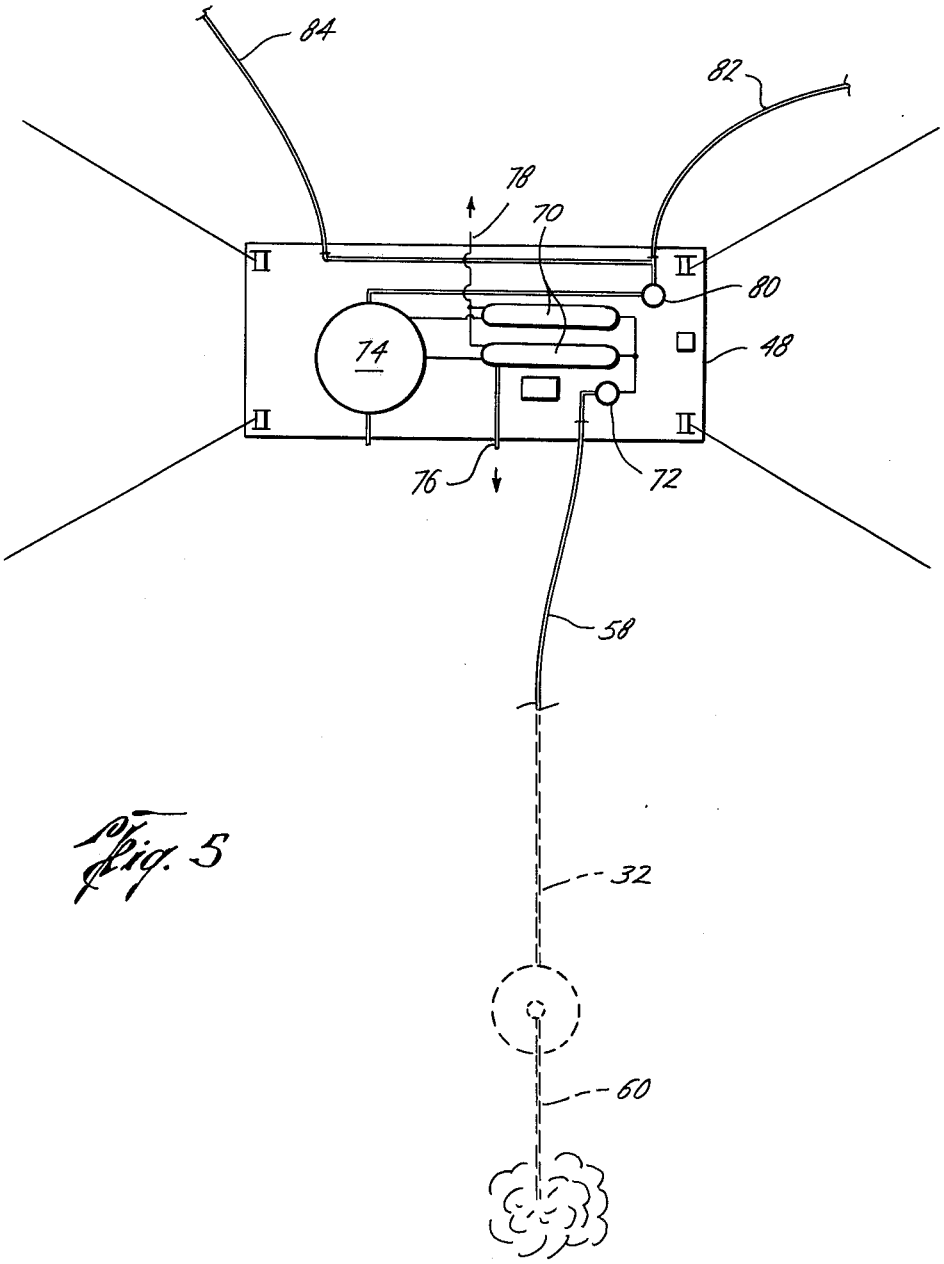
FIG. 5 is a schematic plan view showing the production barge and its equipment.

As shown in FIG. 4, when vessel 10 is in position on the bottom, hose 32 is pulled from the surface and connected to swivel 34. Hose 32 extends to swivel 50 which is connected by anchor line 52 to anchor 54 and is supported above the bottom by buoy 56. Loading hose 58 extends from swivel 50 to production barge 48 where it is connected to pumping and production equipment as shown in FIG. 5 and hereinafter described. Also, gas hose 60 is connected to line 38 with a suitable quick connecting fitting 62. Hose 60 is positioned, as shown, above the lower end of line 38. Usually, the gas is vented and if so the outer end of hose 60 extends in the opposite direction away from vessel 10 to the direction in which hose 32 extends. The outer end of line 60 is supported by buoy 64 and held in place by anchor line 66 extending to anchor 68. Alternately, gas may be vented or flared at the surface or may be injected into a pipeline.

As shown in FIG. 5, oil rises through line 32 and hose 58, due to the difference of specific gravities of the oil and the surrounding water, and is pumped through separators 70 by pump 72 into tank 74. Separators 70 separate remaining water from the oil. Water is discharged through water discharge line 76, and gas is vented through vent line 78. Oil is pumped from tank 74 by pump 80 to either or both of off loading hoses 82 and 84. Thus, oil from blowing well 46 is recovered in tank 74 and can be off loaded into suitable tankers (not shown) for delivery to a refinery or storage area. Two off loading hoses are used to be able to have a continuous connection to at least one tanker.

The rate at which pump 72 and any other pumps which assist in withdrawal of oil from vessel 10 is controlled so that none of the oil flows out vent ports 24. The rate should be controlled to pump a slight bit of water with the oil.

Thus, the improved structure and method of the present invention can be used not only to control a blowing well but also to separate the water and gas from the oil and pump the oil to a suitable collecting place.

What is claimed is:

1. An underwater well blowout container comprising a hollow body,
   - a weighted collar surrounding the lower end of said body,
   - a frusto-conical top secured to the upper end of said body,
   - a chimney extending above the upper end of said top,
   - a valve in said chimney for opening and closing flow through said chimney,
   - a plurality of openings in the lower portion of said body,
   - a gas discharge line connected into said chimney and extending downwardly to a level below said chimney, and
   - an oil discharge connected into said body at a level above said openings and below the lowest level of said gas discharge line.

2. A container according to claim 1 wherein the flow area through said chimney when said valve is open is substantially larger than the flow area of the blowing well.

* * * * *